US005205096A

United States Patent [19]

Pace

[11] Patent Number: 5,205,096

[45] Date of Patent: Apr. 27, 1993

[54] REINFORCING ASSEMBLY FOR A GARAGE DOOR OR THE LIKE

[76] Inventor: Rex A. Pace, 1222 Treetop Village, Ballwin, Mo. 63025

[21] Appl. No.: 784,227

[22] Filed: Oct. 31, 1991

[51] Int. Cl.[5] ..... E06B 3/48

[52] U.S. Cl. ..... 52/223.6; 52/291

[58] Field of Search ..... 52/226, 291, 638, 640; 160/201

[56] References Cited

U.S. PATENT DOCUMENTS

| | | | |
|---|---|---|---|
| 2,856,644 | 10/1958 | Dunham | 52/226 |
| 3,882,651 | 5/1975 | Gilchrist | 52/226 |
| 4,353,190 | 10/1982 | Gleeson | 52/226 |
| 4,987,941 | 1/1991 | Wold | 160/201 |

FOREIGN PATENT DOCUMENTS

| | | | |
|---|---|---|---|
| 60044 | 3/1975 | Australia | 52/226 |
| 239453 | 10/1911 | Fed. Rep. of Germany | 52/640 |
| 5537 | of 1889 | United Kingdom | 52/226 |

*Primary Examiner*—Richard E. Chilcot, Jr.
*Assistant Examiner*—Joanne C. Downs
*Attorney, Agent, or Firm*—Frank B. Janoski

[57] ABSTRACT

A reinforcing assembly for a garage door or the like comprising an upper cross member extending from one side of the garage door to the other side and two lower cross members extending from the ends of the upper cross members downwardly. The assembly also includes a bracket for joining said lower cross members and tensioning means connected to said lower cross members.

8 Claims, 1 Drawing Sheet

REINFORCING ASSEMBLY FOR A GARAGE DOOR OR THE LIKE

BACKGROUND OF THE INVENTION

This invention relates generally to a reinforcing assembly for a garage door, and more particularly, to a reinforcing assembly for use with a wooden double-wide four panel garage door which sags in the middle of the door.

The problem with wood panel garage doors is that over time they begin to sag in the middle of the door, thereby raising the edges of the door and giving the door the appearance of a "smile". The only remedy thus far has been to either replace the entire garage door at great expense or to add unsightly straps to the exterior of the door to raise the sagging portion. These remedies are not only expensive, but in some instances makes it impractical to have a wooden garage door which may match the exterior of a home.

SUMMARY OF THE INVENTION

Among the several objects of this invention may be noted the provision of a reinforcing assembly for a garage door which is simple in construction and inexpensive to make; the provision of such a reinforcing assembly which is simple to erect and asthetically pleasing; the provision of such a reinforcing assembly that can be used to prevent sagging of the door and which can be installed easily by homeowners; the provision of such a reinforcing assembly that will restore a sagging garage door to its original appearance; and the provision of a reinforcing assembly that can be sold to garage owners as a kit for simple installation.

In general, a reinforcing assembly for a garage door or the like of this invention comprises an upper cross member extending from one side of the garage door to the other side and two lower cross members extending from the ends of the upper cross member. The assembly also consists of means for joining the lower cross members and tension means connected to the lower cross members.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 2:
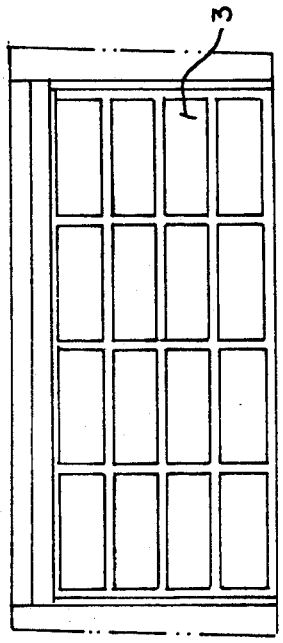
FIG. 2 is a front view of the exterior of a garage door with the invention installed.
Figure 1:
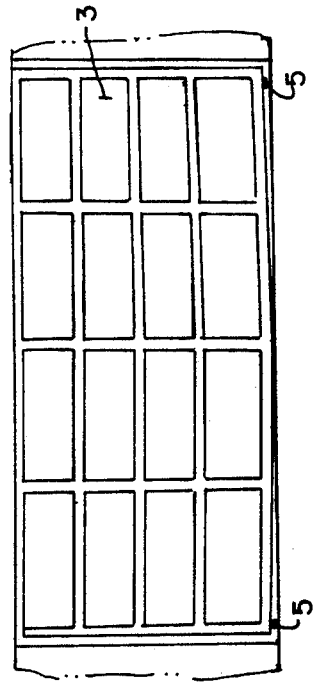
FIG. 1 is a front view of the exterior of a sagging garage door without the invention installed.

Referring generally to the drawings, a reinforcing assembly of this invention, generally indicated at 1, is for a garage door 3 which sags in the middle, thereby causing gaps 5 to occur at the lower corners of the door. See FIG. 1. The invention, as described more fully hereinafter, is designed to correct this situation and return the garage door to its original appearance as shown in FIG. 2.

The reinforcing assembly of this invention consists of an upper cross member 7 and two lower cross members 9 and 11. The upper cross member is sized to span approximately the entire width of the particular garage door 3. The upper cross member has several openings therein 13, the purpose of which will be discussed later. The cross member shown in the drawing is made of 15 gauge square tubing. However, as will be understood by those familiar with the art, other materials such as angle iron or the like may be used.

Figure 3:
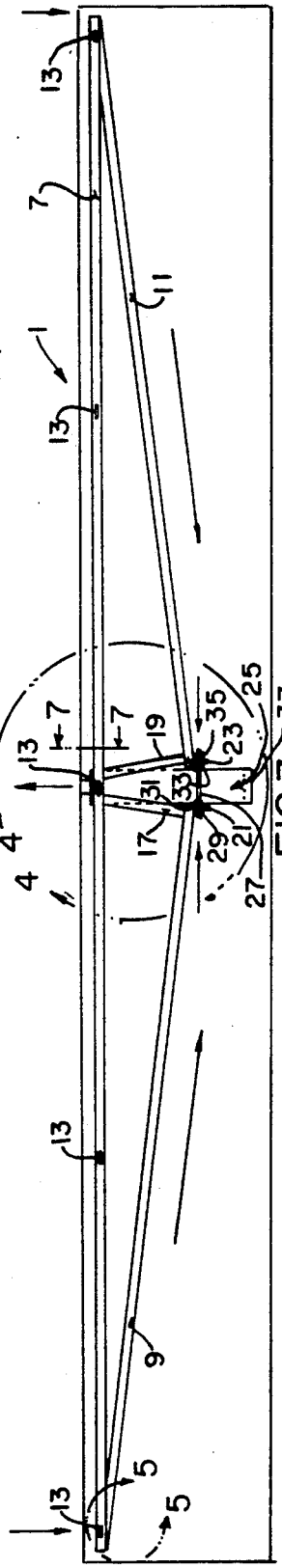
FIG. 3 is a front view of the interior side of the lower panel of a garage door with the invention installed thereon.
Figure 7:
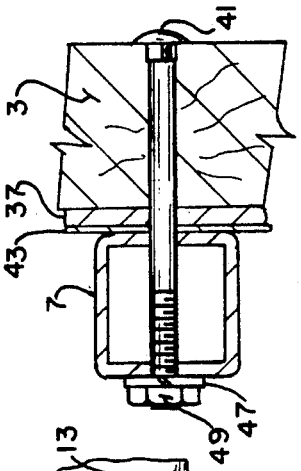
FIG. 7 is a vertical section on line 7—7 of FIG. 3.
Figure 6:
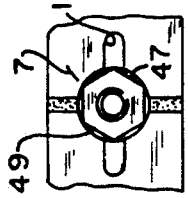
FIG. 6 is an enlarged section of FIG. 4.

As particularly shown in FIG. 3, the lower cross members are joined to the end of the upper cross member such that the lower cross members extend downwardly and towards the middle of the garage door. The length of each lower cross member is approximately one-half of the upper cross member. The angle created by the upper and lower cross members is between four and fifteen degrees. As will be understood by those familiar in the art, this angle will vary depending on the size of the garage door and where the upper cross member is positioned. However, the angle for a sixteen foot garage door is generally eight degrees. The lower cross members are affixed at the ends of the upper cross member by either welding 15 or other suitable means. The lower cross members generally are made of the same materials as the upper cross members.

Vertical members 17, 19 are positioned between the lower cross members at their free ends and the upper cross member. The vertical members are fixed to the lower cross members by suitable means, such as welding or the like, and are positioned at a right angle to the respective lower cross member. The attachment of the vertical member to each lower cross member creates two A-frame units.

Figure 4:
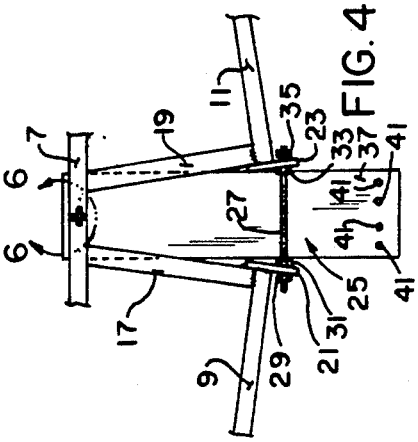
FIG. 4 is an enlarged section of FIG. 3.
Figure 5:
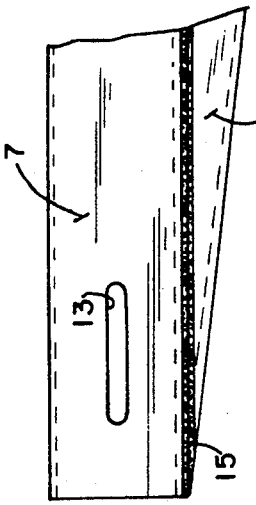
FIG. 5 is an enlarged section of FIG. 3.

At the right angle connection of the lower cross member and vertical member, flat plate hangers 21, 23 are suitably affixed thereto, i.e., welding or the like. The hangers extend along the respective vertical member, across the end of the lower cross member and downwardly beyond the lower cross member. Each hanger has an opening (not shown) at its free end for receiving a screw and nut combination, generally shown at 25, constituting means for applying tension to the assembly as will be explained later. A double threaded screw 27, as shown in FIG. 4, is designed to extend between the hangers and through their openings. A pair of nuts 29, 31, 33, and 35 is positioned on each side of the hanger as will be described later.

A flat plate 37 is designed to extend downwardly from the center of the upper cross member. The plate has an opening (not shown) at its top end and four openings 39 in the lower end.

The reinforcing assembly is mounted, as shown in FIG. 3, to the bottom panel of a garage door or the like by removing the existing carriage bolts from the bottom hinges of the door and replacing them with longer carriage bolts 41. The top opening of the flat plate is then placed over the center carriage bolt and the bottom of the plate is secured to the garage door with the use of screws or other types of fasteners as will be understood by those familiar in the art. Next, the openings of the upper cross member are placed over the carriage bolts and secured by means of lockwashers 47 and nuts 49. This hangs the assembly on the garage door.

Two nuts 31 and 33 are then screwed onto the threaded screw 27 and the ends of the screw and the ends of the screw are positioned through the respective holes of the hangers. Two more nuts 29 and 35 are then screwed onto the ends of the screw and tightened against the hangers to apply inward and downward force at the ends of the upper cross member and an upward force to the center of the upper cross member thereby raising the center of the sagging door and lowering the ends of the garage door. Once the bottom of the garage door has been leveled, the inside nuts 29 and 35 are tightened against the hangers to lock the assembly in place.

It will be understood that the assembly can be made available to the public either in a fully assembled package, ready to be hung on a standard door, or in components thereby requiring welding or other type of assembly to construct the invention. In addition, the assembly can be used prior to the garage door beginning to sag in order to prevent such a situation from occurring.

In view of the above, it will be seen that the several objects of the invention are achieved and other advantageous results attained.

As various changes could be made in the above construction without departing from the scope of the invention, it is intended that the matter contained in the above description or shown in the accompanying drawings shall be interpreted as illustrative and not in a limiting sense.

I claim:

1. A reinforcing assembly for a garage door or the like comprising:

an upper cross member extending from one side of the garage door to the other side;

a plurality of lower cross members extending from the ends of the upper cross member downwardly;

means for joining said lower cross members; and tensioning means connected to said lower cross members.

2. A reinforcing assembly as set forth in claim 1 where said tensioning means comprises a nut and bolt arrangement.

3. A reinforcing assembly as set forth in claim 1 wherein the angle between the upper cross member and downwardly extending lower cross members is between 4 and 15 degrees.

4. A reinforcing assembly as set forth in claim 1 wherein the angle between the upper cross member and downwardly extending lower cross members is 8 degrees.

5. A reinforcing assembly for a garage door or the like comprising:

an upper cross member extending from one side of the garage door to the other side;

a plurality of lower cross members, each lower cross member having one ned thereof extending from an end of the upper cross member downwardly;

a plurality of vertical members, said vertical means extending from the other end of the lower cross members to the upper cross member; and tensioning means connected to said lower cross members.

6. A reinforcing assembly as set forth in claim 5 wherein said tensioning means comprises a nut and bolt arrangement.

7. A reinforcing assembly as set forth in claim 5 wherein the angle between the upper cross member and downwardly extending lower cross members is between 4 and 15 degrees.

8. A reinforcing assembly as set forth in claim 5 wherein the angle between the upper cross member and downwardly extending lower cross member is 8 degrees.

* * * * *